US006837218B2

(12) United States Patent
Frank

(10) Patent No.: US 6,837,218 B2
(45) Date of Patent: Jan. 4, 2005

(54) RADIAL PISTON PUMP

(75) Inventor: Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/070,314

(22) PCT Filed: Jun. 15, 2001

(86) PCT No.: PCT/DE01/02234

§ 371 (c)(1),
(2), (4) Date: Jun. 25, 2002

(87) PCT Pub. No.: WO02/02937

PCT Pub. Date: Jan. 10, 2002

(65) Prior Publication Data

US 2002/0179061 A1 Dec. 5, 2002

(30) Foreign Application Priority Data

Jul. 5, 2000 (DE) ..... 100 32 577

(51) Int. Cl.[7] ..... F02M 37/04
(52) U.S. Cl. ..... 123/456; 123/495; 92/158
(58) Field of Search ..... 123/456, 450, 123/495, 196 R; 92/153, 158, 159, 57

(56) References Cited

U.S. PATENT DOCUMENTS 4,516,475 A * 5/1985 Fricke ..... 92/57
5,313,919 A * 5/1994 Rao et al. ..... 123/193.4
5,315,970 A * 5/1994 Rao et al. ..... 123/193.2
5,983,863 A * 11/1999 Cavanagh et al. ..... 123/447
6,378,499 B1 * 4/2002 Shimayama et al. ..... 123/456
6,510,843 B2 * 1/2003 De Matthaeis ..... 123/506

FOREIGN PATENT DOCUMENTS

DE 19847044 * 4/2000

* cited by examiner

*Primary Examiner*—Carl S. Miller
(74) *Attorney, Agent, or Firm*—Ronald E. Greigg

(57) ABSTRACT

The invention relates to a radial piston pump for generating high fuel pressure in fuel injection systems of internal combustion engines, in particular in a common rail injection system, having a driveshaft, supported in a housing, that has an eccentrically embodied shaft portion which cooperates with preferably a plurality of pistons capable of reciprocating radially, relative to the driveshaft, in a respective element bore, in order to aspirate fuel and subject it to high pressure in a high-pressure region. In order to increase the efficiency and lengthen the service life, in the outer jacket face (3) of the pistons and/or the inner jacket face of the element bore, a structure in the $\mu$m range is formed.

2 Claims, 1 Drawing Sheet

RADIAL PISTON PUMP

CROSS-REFERENCE TO RELATED APPLICATIONS

This application is a 35 U.S.C.371 application of PCT/DE 01/02234, filed on Jun. 15, 2001.

BACKGROUND OF THE INVENTION

1. Field of the Invention

The invention relates to a radial piston pump for generating high fuel pressure in fuel injection systems of internal combustion engines, in particular in a common rail injection system, having a driveshaft, supported in a housing, that has an eccentrically embodied shaft portion which cooperates with preferably a plurality of pistons capable of reciprocating radially, relative to the driveshaft, in a respective element bore, in order to aspirate fuel and subject it to high pressure in a high-pressure region.

2. Description of the Prior Art

A radial piston pump of the generic type described above is known from German Patent Disclosure DE 198 47 044 A1. In the known radial piston pump, an annular groove which communicates with a plurality of axially disposed grooves or channels is made in the outer jacket face of the pistons in the circumferential direction. The macroscopic channels serve to orient the pistons "hydraulically", each in the associated element bore.

The running paths of the pistons and of the element bores must on the one hand be very smooth and have a uniform surface. On the other hand, a certain quantity of the medium to be compressed should adhere as lubricant to the surfaces, which dictates a certain surface roughness. This roughness subtracts from the load-bearing portion of the surface; that is, the full jacket face of the pistons and of the element bores cannot be effectively utilized as a running path. The surface roughness also limits the accuracy of shape and dimension to be attained. This limitation means that certain minimum plays cannot be undershot, which in turn lowers the efficiency of the radial piston pump. This effect is all the more pronounced, the higher the pressure in the radial piston pump becomes.

It is the object of the invention to increase the efficiency and lengthen the service life of the known radial piston pump.

SUMMARY OF THE INVENTION

In a radial piston pump for generating high fuel pressure in fuel injection systems of internal combustion engines, in particular in a common rail injection system, having a driveshaft, supported in a housing, that has an eccentrically embodied shaft portion which cooperates with preferably a plurality of pistons capable of reciprocating radially, relative to the driveshaft, in a respective element bore, in order to aspirate fuel and subject it to high pressure in a high-pressure region, this object is attained in that in the outer jacket face of the pistons and/or the inner jacket face of the element bore, a structure in the $\mu$m range is formed.

The running paths formed on the piston jacket face and in the element bore can, in the radial piston pump of the invention, be embodied very smoothly and accurately in terms of shape. As a result, very small plays are attainable, which especially at high pressures, because the gap losses are so slight, leads to good efficiency of the radial piston pump. The smooth surfaces would, however, hinder adequate lubrication in operation of the radial piston pump and would cause the pistons to seize. The targeted structuring of the surface of the pistons and/or of the element bores has the function of lubricant pockets and lubrication channels. The structuring can be made in a targeted way, for instance with the aid of a laser. Via the structure made in the surface, the lubricant medium is distributed during operation to the lubrication points to be supplied along the running paths. At the same time, the structuring acts as a reservoir for the lubricant medium.

One particular embodiment of the invention is characterized in that the structure is embodied such that in operation there is no direct communication between the high-pressure region, defined by one face end of the respective piston, and a low-pressure region, defined by the other face end. As a result, leakage flows and gap losses are kept as slight as possible.

A further particular embodiment of the invention is characterized in that the structure is formed by lubrication channels, which extend substantially in the circumferential direction. By this means, it is attained in a simple way that there is no communication between the low-pressure region and the high-pressure region. The size of the storage reservoir for the lubricant medium can be defined by way of the number of lubrication channels.

Another particular embodiment of the invention is characterized in that the structure is formed by lubrication channels, disposed in pairs, each of a different length, which each have arms oriented perpendicular to one another, with one arm disposed in the axial direction and the other arm in the circumferential direction of the respective jacket face. As a result, especially good distribution of the lubricant over the surface to be lubricated is achieved.

Another particular embodiment of the invention is characterized in that the structure is formed by many axially extending channels, which are disposed in groups and which communicate with one another through channels extending circumferentially. In this type of in-line connection, the flow resistance in the axial direction can be varied by way of the number of channels extending axially. By means of additional connecting channels in the circumferential direction, the lubrication in certain regions can be improved in a targeted way. The flow resistance is furthermore dependent, among other factors, on the parameters of channel shape, channel cross section and channel length. By a suitable choice of these parameters, the supply of lubricant can be designed to suit what is needed.

BRIEF DESCRIPTION OF THE DRAWINGS

The invention will be described in detail herein below, with reference to the drawings, in which.

DESCRIPTION OF THE PREFERRED EMBODIMENTS

The radial piston pump of the invention is used in particular in common rail injection systems to supply Diesel engines. The term "common rail" means the same as common line. In contrast to conventional high-pressure injection systems, in which the fuel is supplied to the individual combustion chambers via separate lines, the injection nozzles in common rail injection systems are supplied from a common line.

Figure 4:
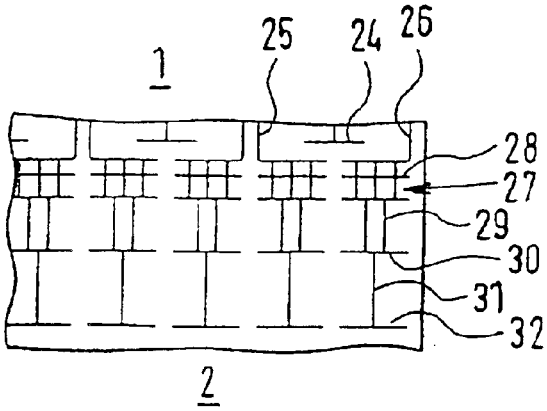
FIG. 4, a portion of the developed view of a piston jacket face in a third embodiment of the invention.

One such radial piston pump is shown in FIGS. 4–6 of DE 198 47 044 A1, for instance. The radial piston pump shown there includes a driveshaft, supported in a pump housing and having an eccentrically embodied shaft portion. A ring is provided on the eccentric shaft portion, and the eccentric shaft portion is rotatable relative to this ring. The ring includes three flat faces, offset from one another by 120° each, and one piston is braced on each of these faces. The pistons are each received in an element bore in a way capable of reciprocating radially to the driveshaft, and they each define one cylinder chamber.

At the foot of each piston, a plate which rests on the associated flat face of the ring is mounted by means of a plate holder. The plate holder is secured to the piston by a snap ring. The radial piston pump serves to subject fuel, which is furnished from a tank by a prefeed pump, to high pressure. The fuel is preferably Diesel fuel. The Diesel fuel subjected to high pressure is then pumped into the aforementioned common line.

In the supply stroke, the pistons are moved away from the axis of the driveshaft as a consequence of the eccentric motion of the ring. In the intake stroke, the pistons move radially toward the axis of the driveshaft, in order to aspirate fuel into the cylinder chambers. The intake stroke motion of the pistons is attained by means of a spring, which is prestressed against the plate holder or the plate.

Figure 1:
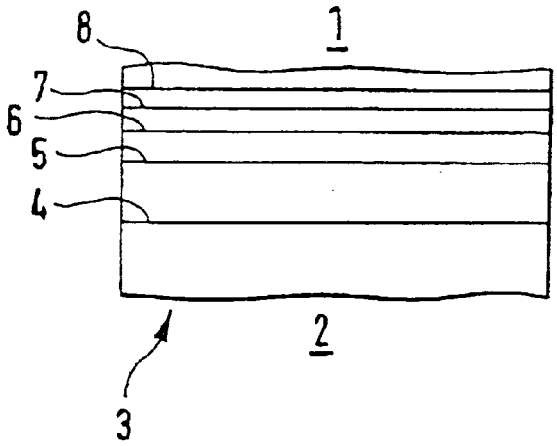
FIG. 1, the developed view of a jacket face of a piston in a first embodiment of the invention.

In FIG. 1, a developed view is seen of the jacket face of a piston of a radial piston pump of the invention. Reference numeral 1 indicates the high-pressure region and reference numeral 2 the low-pressure region of the radial piston pump. The developed view of the piston jacket face is identified overall by reference numeral 3. In the piston jacket face, a plurality of lubrication channels 4, 5, 6, 7 and 8 extending in the circumferential direction are disposed parallel to one another. Toward the high-pressure region 1, the lubrication channels are spaced closer together than toward the low-pressure region 2. The individual lubrication channels do not communicate with one another and in practical terms are connected parallel.

Figure 2:
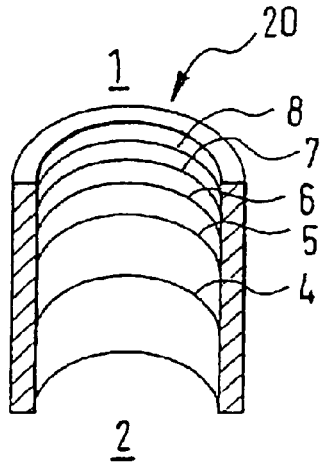
FIG. 2, a perspective sectional view of an element bore of the invention.

FIG. 2 is a perspective view of an element bore 20 in section. On the inner circumferential face of the element bore 20, there are a plurality of lubrication channels 4, 5, 6, 7 and 8 extending in the circumferential direction.

Figure 3:
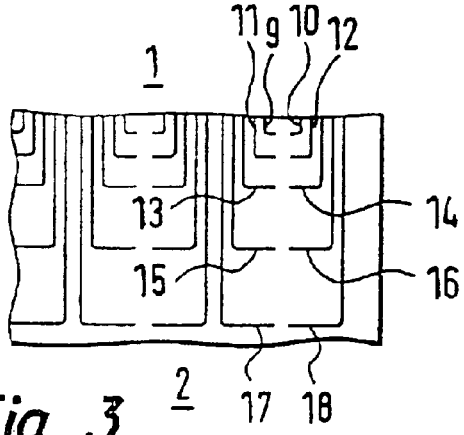
FIG. 3, a portion of the developed view of a piston jacket face in a second embodiment of the invention.

In FIG. 3, a developed view of the jacket face of a piston in a further embodiment of the invention is shown. In the embodiment shown in FIG. 3, ten lubrication channels 9, 10, 11, 12, 13, 14, 15, 16, 17 and 18 each are combined into one group. The lubrication channels 9–18 are L-shaped. One leg of an L-shaped lubrication channel is disposed in the circumferential direction, while the other leg is disposed in the axial direction. Two lubrication channels at a time, with legs of equal length axially, are disposed in pairs with one another in such a way that the legs in the circumferential direction face toward one another.

In the embodiment shown in FIG. 4, a T-shaped lubrication channel 24 is disposed in the vicinity of the high-pressure region 1. The center axis of the T-shaped lubrication channel is oriented toward the high-pressure region 1. The T-shaped lubrication channel 24 is surrounded by or bracketed two L-shaped lubrication channels 25 and 26. From the circumferentially disposed legs of the L-shaped lubrication channels 25 and 26, a plurality of lubrication channels 27 extend axially. The axially extending lubrication channels 27 are intersected by a plurality of lubrication channel extending circumferentially. In FIG. 4, one of these circumferentially extending lubrication channels is marked as an example with reference numeral 28. From the lubrication channels extending circumferentially, in turn a plurality of axially extending lubrication channels originate, of which one is shown as an example at 29 in FIG. 4. Adjoining these axially extending lubrication channels in turn are circumferentially extending lubrication channels 30. These are followed by lubrication channels 31 oriented axially and lubrication channels 32 oriented circumferentially.

The lubrication channels made by means of lasers are not continuous in the axial direction. The lubrication channels are interrupted, in order to keep the gap losses and leakage flows as slight as possible. The lubrication channels can form regular patterns, as shown in FIGS. 3 and 4, or can be disposed irregularly.

The foregoing relates to preferred exemplary embodiments of the invention, it being understood that other variants and embodiments thereof are possible within the spirit and scope of the invention, the latter being defined by the appended claims.

I claim:

1. A radial piston pump for generating high fuel pressure in fuel injection systems of internal combustion engines, in particular in a common rail injection system, having a driveshaft, supported in a housing, that has an eccentrically embodied shaft portion which cooperates with preferably a plurality of pistons capable of reciprocating radially, relative to the driveshaft, in a respective element bore, in order to aspirate fuel and subject it to high pressure in a high-pressure region, wherein the outer jacket face (3) of the pistons and/or the inner jacket face (20) of the element bore having a structure in the $\mu$m range formed therein and wherein the structure is formed by lubrication channels (9–18), disposed in pairs, each of a different length, each channel having arms oriented perpendicular to one another, with one arm disposed in the axial direction and the other arm in the circumferential direction of the respective jacket face.

2. A radial piston pump for generating high fuel pressure in fuel injection systems of internal combustion engines, in particular in a common rail injection system, having a driveshaft, supported in a housing, that has an eccentrically embodied shaft portion which cooperates with preferably a plurality of pistons capable of reciprocating radially, relative to the driveshaft, in a respective element bore, in order to aspirate fuel and subject it to high pressure in a high-pressure region, wherein the outer jacket face (3) of the pistons and/or the inner jacket face (20) of the element bore having a structure in the $\mu$m range formed therein, wherein the structure is embodied such that in operation there is no direct communication between the high-pressure region (1), defined by one face end of the respective piston, and a low-pressure region (2), defined by the other face end and wherein the structure is formed by lubrication channels (9–18), disposed in pairs, each of a different length, each channel having arms oriented perpendicular to one another, with one arm disposed in the axial direction and the other arm in the circumferential direction of the respective jacket face.

* * * * *